United States Patent [19]

Mennesson

[11] 4,175,528

[45] Nov. 27, 1979

[54] FUEL SUPPLY DEVICE FOR INTERNAL COMBUSTION ENGINE

[75] Inventor: Andre L. Mennesson, Neuilly-sur-Seine, France

[73] Assignee: Societe Industrielle de Brevets et d'Etudes S.I.B.E., Neuilly sur Seine, France

[21] Appl. No.: 724,363

[22] Filed: Sep. 17, 1976

[30] Foreign Application Priority Data

Sep. 30, 1975 [FR] France ..... 75 29916

[51] Int. Cl.[2] ..... F02M 39/00

[52] U.S. Cl. ..... 123/139 AW

[58] Field of Search .... 123/139 AW, 139 E, 139 AF, 123/139 AB, 32 EA, 119 EC

[56] References Cited

U.S. PATENT DOCUMENTS

| | | | |
|---|---|---|---|
| 3,596,645 | 8/1971 | Mennesson | 123/139 AW |
| 3,911,884 | 10/1975 | Moriya et al. | 123/139 AW |
| 3,963,009 | 6/1976 | Mennesson | 123/119 D |

*Primary Examiner*—Charles T. Jordan

*Attorney, Agent, or Firm*—Stevens, Davis, Miller & Mosher

[57] ABSTRACT

A fuel supply device comprising auxiliary throttle means located in the intake pipe upstream of an operator actuatable throttle means and a source of pressurized fuel comprising a delivery circuit which opens into a portion of the intake pipe downstream of the main throttle means, the delivery circuit being controlled by at least one solenoid valve. A metering system, which is sensitive to the degree of opening of the auxiliary throttle means, has means supplying repeating pulse signals. The metering system supplies the solenoid valve with one energization signal per pulse signal repetition period which has a duration equal to a fraction of the period which is adjusted by the metering system. The source of fuel has a pressure regulator comprising a relief valve which is biased toward opening by the fuel delivery pressure and toward closure by the vacuum in a chamber connected to the intake pipe. The chamber is bounded by a diaphragm, to which the closure member of the valve is connected. The duct connecting the chamber to the intake pipe communicates with the atmosphere via a second solenoid valve associated with an energizing electric circuit constructed to supply the second solenoid valve with repetitive excitation signals having a duration which varies in dependence on an engine operating parameter.

7 Claims, 3 Drawing Figures

FUEL SUPPLY DEVICE FOR INTERNAL COMBUSTION ENGINE

BACKGROUND AND SUMMARY OF THE INVENTION

The invention relates to fuel supply devices for internal combustion engines of the type comprising auxiliary throttle means located in the intake pipe upstream of operator an actuatable main throttle means, said auxiliary throttle means opening automatically and progressively in proportion to the increase in the air flow rate through the pipe. A source of fuel under pressure having a delivery circuit which opens into a portion of the intake pipe downstream of the main throttle means, the delivery circuit being controlled by at least one solenoid actuated valve and a metering system which is sensitive to the auxiliary throttle means, is provided with means supplying repeating pulse signals and is constructed to supply the solenoid valve with at least one valve energization signal per signal repetition period during a fraction of the period, the fraction being adjusted by the metering system.

Fuel supply devices of the above type are known in which the means delivering a succession of pulses includes a member which is continuously driven in rotation, typically by the engine: the period is then the duration of a 360° rotation of the member.

The adjustment of the fraction of the rotation period (or of the fraction of a revolution) of the means determines the total time during which the valve is opened and consequently determines the flow rate of fuel injected into the intake pipe during aforementioned time interval.

The invention relates more particularly to devices of the aforementioned type wherein the source of fuel under pressure (for instance a fuel pump) has a delivery pipe provided with a pressure regulator comprising a discharge or relief valve which is biased toward opening by the delivery pressure and toward closure by the vacuum in a chamber connected by a connecting duct to that portion of the intake pipe between the two throttle means, the chamber being bounded by a diaphragm connected to the closure member of the valve. Thus, the pressure regulator maintains a fuel pressure which is substantially constant or varies in the same direction as the flow rate of air absorbed by the engine.

The regulator may comprise a discharge valve attached to the diaphragm, one surface of which is subjected to the pressure in that portion of the intake pipe between the two throttle means whereas the other surface is subjected to atmospheric pressure. Since the regulator is usually carried by the fuel tank, it is advantageous for the connection to atmosphere to be via the air vent of the fuel tank, but that arrangement has some disadvantages. The suction in the portion of the intake pipe between the two throttle means depends on the pressure drop produced by the air filter. If the air filter becomes clogged, the degree of vacuum increases and the discharge valve of the regulator is more strongly biased to closure, thus increasing the fuel pressure in the pump delivery pipe and consequently increasing the richness of the air-fuel mixture. The pressure in the fuel tank may vary, inter alia with temperature. More particularly, the pressure in the tank increases in hot weather. If the connection to atmosphere is via the tank, the pressure acting on the diaphragm increases and tends to close the discharge valve, thus further increasing the fuel pressure in the pump delivery pipe and consequently increasing the richness of the air-fuel mixture supplied to the engine.

To avoid excessive fuel consumption and atmospheric pollution by incompletely-burnt exhaust gases, the flow rate of fuel introduced into the intake pipe should preferably be adjusted. An obvious method is to vary the time periods during which the fuel-injecting valve is opened. For this purpose, however, it is necessary to modify the metering system. This method is expensive and different modifications have to be made for each type of engine, so that it is impossible to use a standard system for all engines.

It is an object of the invention to provide a fuel supply device improved with respect to the prior-art devices. It is a more specific object to provide a device which has simple and inexpensive adjusting means so that a standard system can be used for a number of engine types, and can be used when the system is electronic.

According to an aspect of the invention, there is provided a fuel supply system of the afore-mentioned type in which adjustment is achieved by controlling the pressure of the injected fuel so as to obtain an air-fuel mixture having a satisfactory richness. The adjustment means can be designed so as to adapt the richness to a wide range of engine operating parameters, e.g. by using an electric signal supplied by a probe sensitive to an operating condition of the engine or to the richness of the fuel mixture.

More specifically, there is provided a fuel supply device of the afore-mentioned type, the source of fuel under pressure being provided with a pressure regulator comprising a relief valve which is biased toward opening by the fuel delivery pressure and toward closure by the vacuum in a chamber connected to a connected duct to that portion of the intake pipe between the two throttle means, the chamber being bounded by movable or deformable means, such as a diaphragm, to which the closure member of the valve is connected, wherein the connecting duct is connected to atmosphere by a passage provided with a second solenoid valve associated with an energizing electric circuit constructed to supply said second solenoid valve with repetitive excitation signals having a duration which varies in dependence on an engine operating parameter, so that the total time during which the second solenoid valve is opened during a predetermined time period depends on the value of said parameter.

Providing that a sufficient piping volume is left between the solenoid valve and the chamber bounded by the diaphragm, the average vacuum acting on the diaphragm is practically free from fluctuations at the solenoid-valve excitation frequency. A calibrated orifice is typically placed between the duct and atmosphere on the air path controlled by the solenoid valve, the flow cross-sectional area of the orifice being selected in dependence on the flow cross-section of the connection to the intake pipe compartment.

The circuit comprises a pick-up probe for determining the engine operating parameter, which may inter alia be a physical or chemical property of the exhaust gases (e.g. the CO or oxygen content) representative of the richness of the fuel-air mixture.

The invention will be more clearly understood from the following description of a device constituting an embodiment thereof, given by way of non-limitative example.

SHORT DESCRIPTION OF THE DRAWINGS

DESCRIPTION OF A PREFERRED EMBODIMENT

Figure 1:
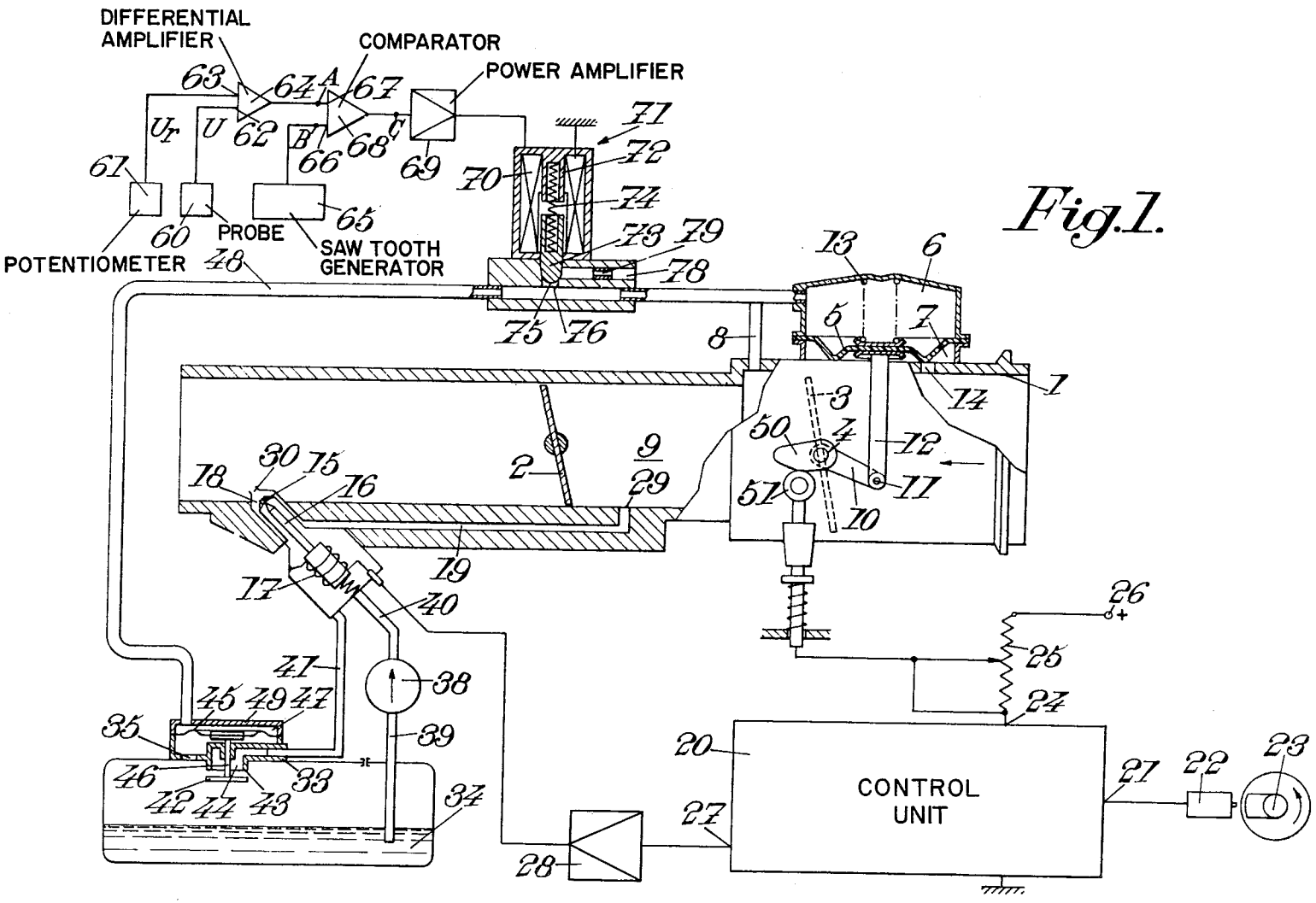
FIG. 1 is a general schematic view of the fuel supply device.

The fuel supply device illustrated in FIG. 1 comprises:

in the intake pipe 1 of the engine, auxiliary throttle means 3 located upstream of main throttle means consisting of a butterfly valve 2 actuated by the operator via a linkage (not shown), the auxiliary throttle means opening automatically and progressively in proportion to the increase in the air flow rate in pipe 1;

means for injecting liquid fuel under pressure into that part of pipe 1 located downstream of the main throttle means 2; and a metering system sensitive to the position of the auxiliary throttle means 3 and adapted to adjust the rate of delivery of injected fuel.

In the embodiment shown, the auxiliary throttle means 3 is a balanced butterfly valve keyed on to a shaft 4. Valve 3 is actuated by a pneumatic device comprising a diaphragm 5 separating two chambers 6, 7. Chamber 6 is connected by a duct 8 to a chamber 9 consisting of that part of pipe 1 which is located between the main throttle means 2 and the auxiliary throttle means 3. Shaft 4 is secured to a lever 10 provided at its free end with a pivotal connection with the end of a rod 12 connected to diaphragm 5. A spring 13 constantly tends to close valve 3 against the action of the vacuum in chamber 6.

Chamber 7 is connected by an aperture 14 to the intake pipe 1 upstream of the auxiliary throttle means 3, so that the pressure in chamber 7 is substantially atmospheric.

The angular position of auxiliary throttle means 3 at each instant is representative of the air flow rate in pipe 1. If the air flow rate increases, the auxiliary throttle means 3 opens in proportion so that the resulting pressure in chamber 9 between throttle means 2 and 3 is substantially constant (or slightly increases, depending on the characteristics of spring 13). Although the illustrated throttle means gives satisfactory results, it could be replaced by known technical equivalents.

The injection means comprise a source of fuel under pressure having a delivery pipe 40 which supplies at least one injection valve 16 which opens into pipe 1 downstream of the main throttle means 2. Valve 16 is actuated by a solenoid or electromagnet 17 energized by rectangular current pulses periodically transmitted by the metering system.

The injection orifice 15 of valve 16 opens into a chamber 18 which is connected, firstly, to that part of pipe 1 upstream of butterfly valve 2 via a duct 19 opening into chamber 9 via an orifice 29 and, secondly, to that part of pipe 1 disposed downstream of butterfly valve 2 by an auxiliary orifice 30 in line with orifice 15.

In the embodiment shown in FIG. 1, the metering system comprises:

a rotating member 23 which will hereinafter be assumed to be driven by the engine (although this is not necessary) and which, at each revolution, influences a device 22 for producing electric triggering pulses;

means sensitive to the position of the auxiliary throttle means 3 and supplying information in the form of an electric signal; in FIG. 1, such means comprise a push rod actuated by a cam 50 carried by shaft 4 and a roller 51 which moves the slide of a variable resistor 25 connected to a constant voltage d.c. source 26; and a control unit 20 having an input 21 receiving triggering pulses from device 22, an input 24 receiving electric information from resistor 25 and an output 27 which supplies a rectangular energizing signal which is subsequently amplified by an amplifier 28 and fed to the solenoid valve 17. The control unit may be for instance of the type described in U.S. Pat. No. 3,867,913 or U.K. Pat. No. 1,266,803 to which reference may be had.

The source of fuel comprises a tank 34 supplying a pump 38 having a suction pipe 39 connected to the bottom of tank 34 and a delivery pipe 40 connected to valve 16. A return or pressure relief pipe system 41 has a connection to tank 34 controlled by a pressure regulator 33. Pressure regulator 33 comprises a valve 42 cooperating with a seat 43 comprising the lower part of a chamber 44 where the return pipe system 41 ends, and also comprising a movable or deformable element which, in the present embodiment, consists of a diaphragm 45 secured to valve 42 by a rod 46 and cooperating with a cover 49 to bound a chamber 47 connected to chamber 9 by a connecting duct 48.

That surface of diaphragm 45 which is remote from the vacuum chamber 47 is connected to atmosphere by an orifice 35, by the top part of the fuel tank filled with air and fuel vapor and by the air vent of the tank. The vacuum in chamber 47 exerts a force on diaphragm 45 tending to close valve 42, whereas the pressure of fuel delivered to chamber 44 acts on valve 42 and tends to open it.

In the embodiment of the invention shown, a pick-up probe 60 is provided and supplies an electric signal having a voltage U indicating the richness of the air-fuel mixture supplied to the engine. Pick-up probe 60 is, e.g. an oxygen probe placed in contact with the engine exhaust gases. Then, the signal voltage U depends on the oxygen content of the exhaust gases. Alternatively, the pick-up may be sensitive to other physical or chemical parameters of the exhaust gases.

Signal voltage U is sent to an input 62 of a differential amplifier 64 having another input 63 which receives a reference voltage $U_r$ from a voltage generator, e.g. a potentiometer 61 associated with a d.c. source. Amplifier 64 supplies an output signal A proportional to the difference between the input signals. The output signal A is applied to one input 67 of a comparator 68 whose other input 66 is connected to the output of a generator 65 of saw-tooth signals whose average value is zero. The frequency of the saw-tooth signals should be sufficiently high to prevent interfering pulsation in the operation of pressure regulator 33. The frequency is typically between 30 and 300 hertz.

The output signal of comparator 68, consisting of voltage square waves, is amplified by a power amplifier 69 and applied to the coil 70 of a solenoid valve 71.

Valve 71 has a stationary central core 72 and a plunger 73. When an electric current flows in coil 70, plunger 73 is attracted to core 72, against the action of a return spring 74 which tends to hold the outer end 75 of plunger 73 against a seat 76, thus disconnecting the connecting duct 48 from duct 78 opening to atmosphere via a calibrated orifice 79. It will be noted that the electronic circuit is similar to that disclosed in U.S. Pat. No. 3,596,645 or U.K. application No. 14064/74.

Operation of the device will now be described with reference to FIGS. 2 and 3.

If the fuel supply device provides an air-fuel mixture of correct richness, pick-up probe 60 supplies a voltage U substantially equal to the reference voltage $U_r$. In that case the output voltage A of amplifier 64 is zero since the voltages at inputs 62, 63 are equal (FIG. 2).

Figure 2:
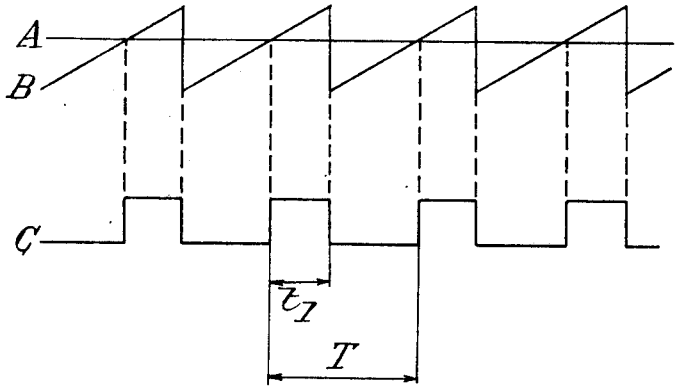
FIG. 2 is a diagram showing the electric signals which appear at various places in the device of FIG. 1 when the air-fuel mixture supplied to the engine is of optimum richness.
Figure 3:
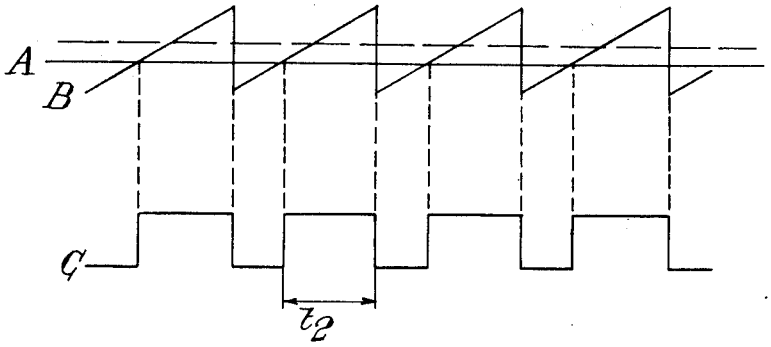
FIG. 3, which is similar to FIG. 2, corresponds to a solenoid-valve excitation time $t_2$ necessary for adjusting a mixture which has become too rich and greater than the time $t_1$ corresponding to optimum conditions.

Comparator 68 compares voltage A with the saw-tooth voltage signal of the generator, which has a period T and is represented by curve B in FIG. 2. A rectangular signal (C in FIG. 2) appears at the output of comparator 68 and comprises electric square signals which have the duration $t_1$. Each square signal begins when the voltages A and B are equal and ends upon occurrence of the steep leading edge of the next saw-tooth of signal B.

The electric signals of duration $t_1$ are amplified and then sent to the coil of solenoid valve 71. Plunger 73 connects duct 48 to atmosphere via duct 78 and calibrated orifice 79 at time intervals T, and then closes it at the end of the duration $t_1$. The vacuum in chamber 47 of pressure regulator 33 remains at a value which depends on the flow cross-sectional area of orifice 79 and the time $t_1/T$, so that the fuel delivered to valve 16 is under a given pressure.

Any increase of the ratio between the opening time and the closure time of valve 71 (i.e. of $t_1/T$) results in a corresponding decrease in the degree of vacuum transmitted to pressure regulator 33 from chamber 9 and a similar decrease in the fuel pressure in the circuit supplying valve 16.

If the richness of the air-fuel mixture supplied to the engine increases for any reason (such as a drop in atmospheric pressure, or an increase in ambient temperature, or clogging of the air filter), the voltage U becomes different from the reference voltage $U_r$. The connections are made so that the level of signal A decreases (FIG. 3). Comparator 68 then supplies current square waves (curve C in FIG. 3) having a duration $t_2$ greater than $t_1$. Consequently, solenoid valve 71 is open for a longer total time and the degree of vacuum transmitted to regulator 33 is decreased, resulting in a drop in the pressure of fuel supplied to the injection solenoid valve.

The resulting device is simple, uses an on/off solenoid valve 71 instead of a progressive regulating valve and is able to maintain the richness of the air-fuel mixture supplied to the engine at a substantially constant value. Amplifier 64 and generator 65 can be adapted so that the duration of the current square waves is very sensitive to any variation of voltage U.

Many modifications are possible. For instance, the richness of the air-fuel mixture can be varied in dependence on additional parameters depending on engine operating characteristics. To this end, for example, the reference voltage $U_r$ can be varied in dependence on one or more parameters, e.g., on the engine load as determined by the position of the main throttle means 2. The solenoid valve 71 can be located differently, e.g., can be constructed to disconnect chamber 47 from the intake pipe compartment when energized.

I claim:

1. A fuel supplying device for an internal combustion engine comprising:

an intake pipe, operator actuatable main throttle means in said pipe, auxiliary throttle means located in said intake pipe upstream of said main throttle means, said auxiliary throttle means automatically and progressively opening in proportion to the increase in the flow rate of air in said intake pipe, a source of fuel under pressure having a delivery circuit which opens into a portion of the intake pipe downstream of the main throttle means, first solenoid valve means controlling the flow of fuel in said delivery circuit, a metering system which is responsive to the degree of opening of the auxiliary throttle means having means delivering repeating pulse signals and arranged to supply said first solenoid valve means with at least one energization signal per pulse signal repetition period, said energization signal being applied for a fraction of the repetition period which depends on said degree of opening, and pressure regulator means with said delivery circuit and including a relief valve having a closure member, said relief valve being subjected to an opening force by the fuel pressure in said delivery circuit and subjected to a closure force by the vacuum in a control chamber connected by connecting duct means to that portion of the intake pipe between the two throttle means, second solenoid valve means controlling communication between said duct means and the atmosphere, and an energizing electric circuit for said second solenoid valve comprising means responsive to at least one engine operating parameter which is modified upon a change in the fuel injection pressure, said electric circuit supplying said second solenoid valve with repetitive excitation signals having a duration which varies in dependence on said parameter, the total time during which the second solenoid valve means is fully open during a predetermined time period depending upon the value of said parameter.

2. A device according to claim 1, further comprising a calibrated orifice having a flow cross-sectional area selected in dependence on the cross-sectional area of the connecting duct to the compartment of the intake pipe, disposed between the duct and atmosphere in the air path controlled by the second solenoid valve.

3. A device according to claim 2, wherein the repetition frequency of the signals sent to the second solenoid valve is betweem 30 Hertz and 300 Hertz.

4. A device according to claim 1, wherein the circuit comprises a pick-up probe for determining the value of said parameter.

5. A device according to claim 4, wherein the output signal of the pick-up probe is applied to an input of a differential amplifier whose other input receives a reference voltage from a generator, and the amplifier output signal is applied to one input of a comparator whose other input is connected to a sawtooth signal generator, the output signal of the comparator being amplified and applied to the solenoid valve.

6. A device according to claim 4, wherein the parameter is a physical or chemical property of the exhaust gases indicating the richness of the mixture.

7. A device according to claim 1, wherein said second solenoid valve means is located on said duct means at a distance from the relief valve such that a sufficient damping volume is left between said second solenoid valve means and said control chamber for the average pressure to be substantially free from variations at the frequency of energization of said solenoid valve.

* * * * *